United States Patent [19]

Wolf et al.

[11] 4,078,889

[45] Mar. 14, 1978

[54] PROCESS FOR DYEING DRY-SPUN AROMATIC POLYAMIDES

[75] Inventors: Gerhard Dieter Wolf; Ralf Miessen; Hans Egon Künzel, all of Dormagen; Francis Bentz, Cologne, all of Germany

[73] Assignee: Bayer Aktiengesellschaft, Leverkusen, Germany

[21] Appl. No.: 602,678

[22] Filed: Aug. 7, 1975

[30] Foreign Application Priority Data

Aug. 10, 1974 Germany ..... 2438543

[51] Int. Cl.[2] ..... D06P 5/00; D06P 3/24

[52] U.S. Cl. ..... 8/168 B; 8/41 B; 8/42 B; 8/85 B; 8/86; 8/162 S; 8/171; 8/172 R; 8/172 A; 8/173; 8/178 A; 28/217; 28/247; 264/78

[58] Field of Search ..... 8/168 B, 172 R, 162 S, 8/178 A, 85 B, 86, 171, 173, 172 A; 28/75

[56] References Cited

U.S. PATENT DOCUMENTS

| | | | |
|---|---|---|---|
| 2,558,733 | 7/1951 | Cresswell et al. | 18/34 |
| 3,111,357 | 11/1963 | Wirth et al. | 8/55 |
| 3,233,019 | 2/1966 | Adams | 264/78 |
| 3,242,243 | 3/1966 | Knudson | 264/78 |
| 3,483,576 | 12/1969 | Nakagawa et al. | 8/177 |
| 3,506,990 | 4/1970 | Richardson et al. | 8/172 |
| 3,543,359 | 12/1970 | Whitaker | 28/72.16 |
| 3,602,966 | 9/1971 | Fleissner | 28/102 |
| 3,888,821 | 6/1975 | Milford | 260/45.8 NT |

FOREIGN PATENT DOCUMENTS

| | | |
|---|---|---|
| 708,043 | 6/1968 | Belgium. |
| 2,000,927 | 7/1971 | Germany. |

*Primary Examiner*—A. Lionel Clingman
*Attorney, Agent, or Firm*—Plumley and Tyner

[57] ABSTRACT

The invention relates to a process for the production of dyed filaments from aromatic polyamides which are modified with acid groups.

12 Claims, No Drawings

PROCESS FOR DYEING DRY-SPUN AROMATIC POLYAMIDES

This invention relates to a process for dyeing fully aromatic polyamides which optionally contain heterocycles and which comprise acid groups in order to improve their dyeability, with cationic dyes. The process according to the invention essentially comprises dry-spinning solutions of these acid-modified, fully aromatic polyamides optionally containing heterocycles by conventional methods and passing the resulting filaments before or during stretching through an aqueous bath containing a cationic dye.

The dyeing of wet-spun polyacrylonitrile polymers in "gel form" with water-soluble cationic dyes in an aqueous dye bath has been repeatedly described (U.S. Pat. No. 3,113,827; U.K. Pat. No. 991,957; U.S. Pat. No. 3,111,357; German Pat. No. 1,494,628; U.S. Pat. No. 3,242,243). In order to guarantee a sufficiently deep and washproof dye finish, the acrylonitrile polymers or copolymers are modified with acid groups, preferably sulphonate groups.

In addition, it is known among experts that the dyeing of fully aromatic polyamides optionally containing heterocycles has hitherto proved difficult and expensive, even in cases where the polyamides have contained acid groups in order to improve their dyability. According to one conventional process for dyeing aromatic polyamides, for example poly-m-phenylene isophthalamide, with cationic dyes, the following procedure is adopted:

The bath heated to 30° C, which is kept in constant circulation, has the following additions made to it:

40 — g/l of benzaldehyde emulsion (the benzaldehyde emulsion is made up of 98 parts of benzaldehyde and 2 parts of non-ionic emulsifier), 20 — % of sodium chloride (= 20 g/l of sodium chloride for a dye solution ratio of more than 1:20), 0.5 — % of a standard commercial-grade non-ionic surface-active dispersant, pH 4–4.5 — buffered with trisodium phosphate or tetrasodium pyrophosphate.

The dissolved dye is then added and the temperature of the solution is increased over a period of 45 to 60 minutes to the final required dyeing temperature of 120° to 130° C(pressure vessel). Dyeing takes 1 to 2 hours. The dyeing process is completed by gradual cooling and rinsing.

In order to remove the benzaldehyde from the fibres, the dye finishes obtained have to be subjected to after-treatment under reducing conditions. To this end, the material is treated in a solution containing:

2 — g/l of conc. hydrosulphite, 0.5 — g/l of a standard commercial-grade non-ionic surface-active dispersant, and trisodium phosphate or tetrasodium pyrophosphate to adjust the pH to a value of from 7 to 8.

The temperature of the treatment bath is 90° - 95° C and the treatment time is 10 minutes.

The treatment should be repeated after rinsing."

This proven "high-temperature process" for dyeing aromatic polyamides is extremely complicated, time-consuming and expensive.

Accordingly, it was extremely surprising to find that dry-spun filaments of aromatic polyamides optionally containing heterocycles and comprising generally less than 500 mVal and preferably less than 200 mVal of acid groups per kg of solid polyamide, can be given deep, washproof dye finishes in a simple, continuous process. It is particularly remarkable that the quantity of dye taken up by the filaments can be greater than it is in the "high-temperature dyeing process" described above.

It is an object of this invention to provide a simple and continuous process for the production of dyed filaments of aromatic polyamides.

Other objects will be evident from the following description and the Examples.

These objects are accomplished by a process for the production of dyed filaments of aromatic polyamides, which comprises passing dry-spun filaments of an aromatic polyamide which optionally contains heterocyclic groups and which contains acid groups, before or during stretching, through an aqueous bath containing a cationic water-soluble dye.

Fully aromatic or aromatic polyamides or copolyamides which contain aromatic heterocyclic structures and which comprise acid groups to improve their dyeability with cationic dyes, are already known. Thus, sulphonate groups, for example, can be introduced by co-condensing sulphisophthalic acid or its amide-forming derivatives (Belgian Pat. No. 708,043). Aromatic polyamides containing carboxyl groups have also been produced by co-polycondensing diamines containing carboxyl groups (U.S. Pat. No. 3,386,965; U.S. Pat. No. 3,380,969). Finally, the introduction of acid groups by the co-condensation of disulphimides containing two amino groups has also been described (German Pat. No. 2,000,927).

The quantity of acid groups incorporated may amount to between 50 and 500 mVal per kg of solid polyamide, the range of from 80 to 250 mVal/kg being recommended and particularly preferred.

It is possible in this way to modify almost any known fully aromatic or aromatic polyamides or copolyamides containing heterocycles with acid groups to enable them to be dyed advantageously by the process according to the invention. Aromatic modifiable polyamides of this kind are described, for example, in the following Patent Specifications: U.S. Pat. Nos. 2,979,495; 3,006,899; 3,354,127; 3,380,969; 3,349,061; NE-PS No. 6,809,916; U.K. Pat. No. 718,033; German Pat. Nos. 1,811,411; 1,946,789.

Most of these aromatic polyamides or copolyamides optionally containing heterocycles are soluble in polar organic solvents, such as N,N-dimethyl formamide, N,N-dimethyl acetamide or N-methyl pyrrolidone, at least in cases where a few per cent of an alkali or alkaline earth metal salt, such as calcium chloride or lithium chloride, are added as a solution promoter, and may readily be spun by a conventional dry-spinning process.

Cationic dyes may be used with particular advantage as the water-soluble dyes. A few dyes are identified by way of example in the following:

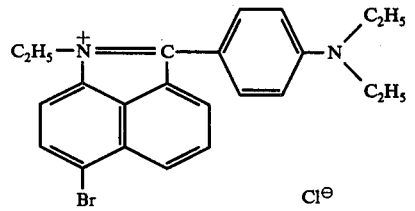

(A)

-continued
(B)
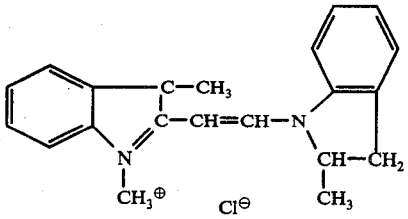
(C)
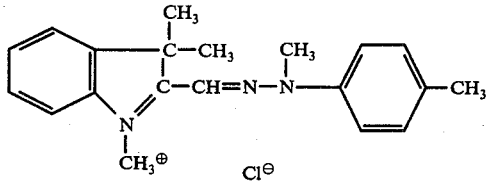
(D)
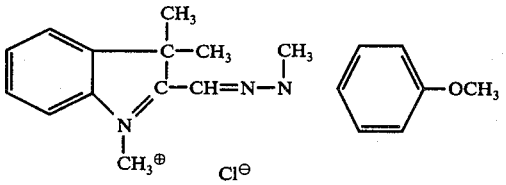
(E)
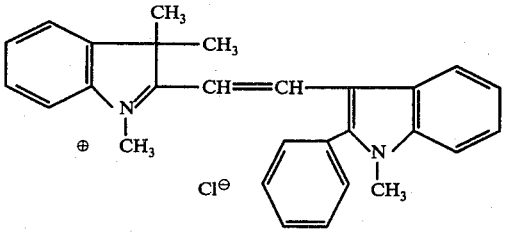
(F)
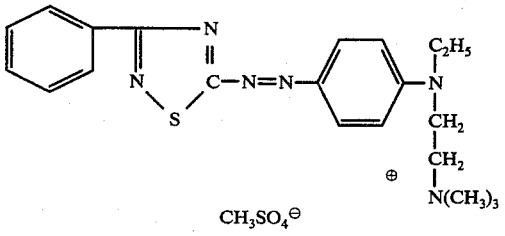
(G)
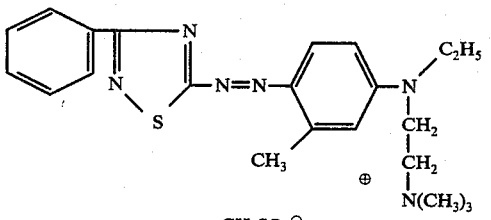
(H)
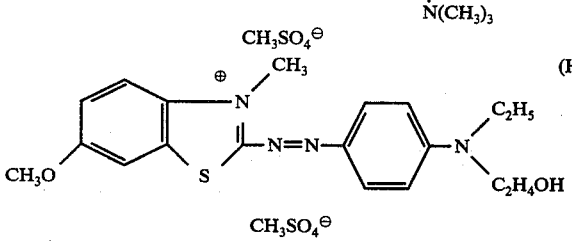
(J)
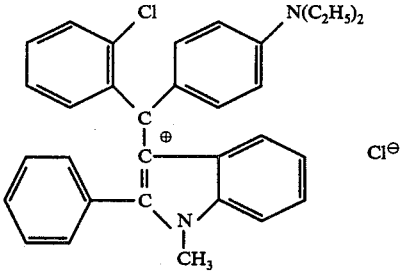
-continued
(K)
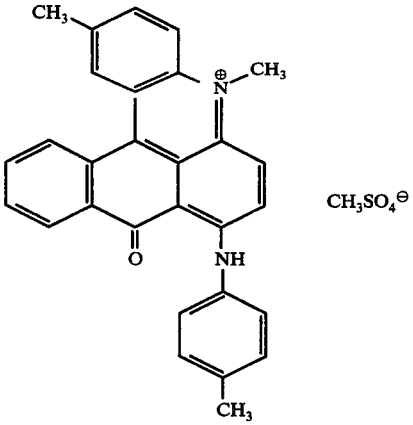
(L)
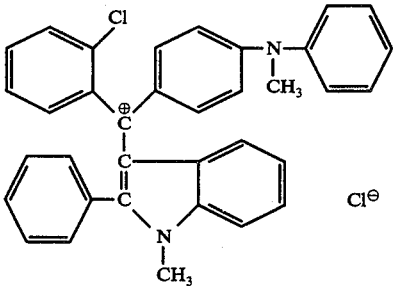
(M)
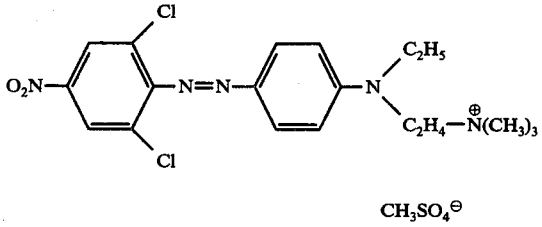
(N)
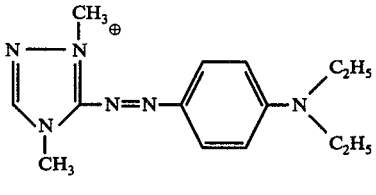
(O)
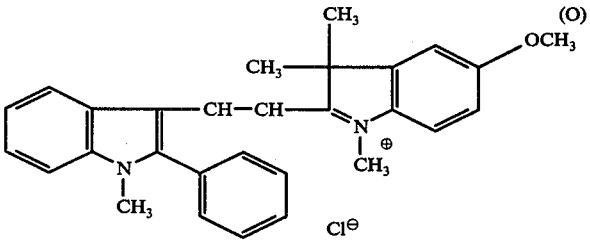
1 : 2 chromium complex of
(P)
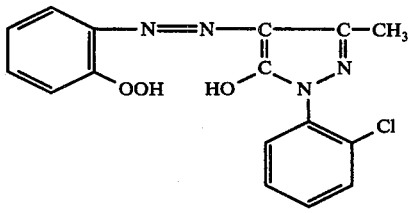
cobalt complex of -continued (Q)

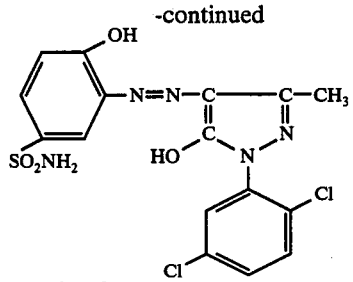

chromium complex of (R)

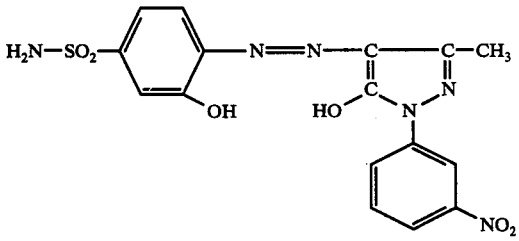

1 : 2 chromium complex of (S)

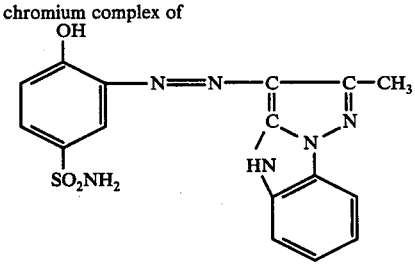

Dyeing of the filaments in the aqueous dye bath is preferably carried out before stretching, although it can also be carried out during or after stretching of the filaments.

The concentration of dye in the dye bath generally amounts to between 0.01 and 5% by weight and preferably to between 0.2 and 1% by weight. The temperature of the dye bath my be in the range of from 20° to 100° C, although it is preferably kept at 50° to 80° C.

In one preferred embodiment, from 1 to 40% by weight and preferably from 10 to 25% by weight (based on the total weight of the bath) of a polar organic solvent, for example diethyl acetamide, N-methyl pyrrolidone, diemthyl formamide or hexamethyl phosphoric acid tris amide, is added to the aqueous dye bath. It is preferred to use the same solvent that is also used for preparing the spinning solution.

More particularly, the process is carried out as follows:

The polycondensation and the preparation of suitable spinning solutions of the polyamides are adequately described in the above-mentioned Patent Specifications. The polyamides used in this process are aromatic polyamides which contain comonomers with acid groups in co-condensed form. The acid groups are preferably the sulphonate and the disulphimide group. The quantity of acid groups incorporated should be in the range of from 50 to 500 mVal and preferably in the range of from 80 to 250 mVal per kg of solid polyamide.

Spinning is carried out by the conventional dry-spinning process in which individual spinning conditions may be varied within wide limits. It is advantageous to use spinning solutions with viscosities in the range of from 1000 to 2500 poises at 20° C and with a solid polyamide concentration, corresponding to those viscosities, of from 17 to 35% by weight. The spinnerets used are 48–288 bore spinnerets with a bore diameter of from 0.2 to 0.3 mm. The spinning duct temperature is between 160° and 220° C. The take-off rate is preferably from 70 to 250 metres per minute.

The dry-spun filaments are introduced before stretching into an aqueous dye bath containing from 0.01 to 5% by weight and preferably from 0.2 to 1% by weight (based on the bath) of a dissolved cationic dye. The bath is kept at a temperature of from 20 to 100° C and preferably at a temperature of from 50 to 80° C. The average residence time of the filaments is from 10 to 30 seconds. In one preferred embodiment of this process, the dye bath additionally contains from 1 to 40% by weight and preferably from 10 to 30% by weight (based on the total weight of the bath) of a polar organic solvent such as N-methyl pyrrolidone, dimethyl acetamide, dimethyl formamide or hexamethyl phosphoric acid tris-amide.

The filaments are then passed through an aqueous washing bath with a temperature in the range of from 20° to 80° C. The residence times in the washing bath are preferably from 10 to 60 seconds, although residence times of up to 5 minutes are also possible. After it has passed through the washing bath, the filaments has a solvent content of less than 3%.

The aftertreatment of the precipitated and washed filaments is governed by the chemical structure of the filaments and is described in the Patent Specifications quoted above. In general, it is best to subject the filaments to a two-stage stretching process, in which they are initially stretched in boiling water in a ratio of from 1:1.2 to 1:2.2 followed by stretching on a curved heating surface or on a godet at a temperature in the range of from 200° to 360° C, the stretching ratio in this second stage of the stretching process being from 1:2.0 to 1:8.0. Preliminary stretching may even be carried out during stretching in the dye bath. The filaments thus obtained show the favourable textile properties which are specific to them and which are described in the Patent literature. In addition, they are given deep, washproof dye finishes by a simple, continuous process. Comparison of this gel-phase dyeing process with the conventional "high-temperature dyeing" process surprisingly shows that dyeing in the gel phase produces a deeper dye finish.

EXAMPLE 1

Preparation and dyeing of filaments of an acid-modified polyamide essentially comprising structural units corresponding to the formula:

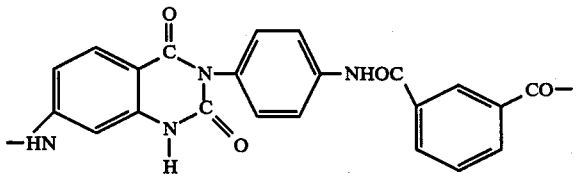

with a blue dye of constitution (A).

(a) Preparation of the polyamide 765 parts by weight of 3-(p-aminophenyl)-7-amino-2,4-(1H,3H)-quinazolindione and 54 parts by weight of sodium di-(m-aminophenyl)-disulphimide were dissolved in 4300 parts by weight of absolute dimethyl acetamide. 610 parts by weight of isophthalic acid dichloride were added in portions with continuous stirring at a temperature of 5 to 10° C, and the viscous solution was stirred at room temperature for about another 12 hours. In the meantime, another 1800 parts by weight of dimethyl acetamide had to be added in order to reduce the viscosity. The hydrochloric acid formed during the polycondensation reaction was taken up with equivalent quantities of propylene oxide.

(b) Production and dyeing of the filaments

This spinning solution with a viscosity of approx. 1500 poises at 20° C ($\eta_{rel}$ = 2.1 as measured on a 0.5% solution in N-methyl pyrrolidone at 20° C) was spun through a 72-bore spinneret (bore diameter 0.2 mm). The gas temperature measured at the spinneret was 140° C and the take-off rate was 130 meters per minute. The tow thus produced was then drawn at 5 meters per minutes through a dye bath which contained 10 g/liter of dye (A) at a temperature of 60° C. The residence time in the dye bath was 14 seconds. The dyed filaments were then washed in boiling water and at the same time pre-stretched in a ratio of 1:1.5. Final stretching in a ratio of 1:1.3 was carried out after drying on a heating godet at a temperature of 290° C. The filament yarn was found to have the following textile properties:
tensile strength: 3.0 - 3.2 g/dtex
elongation: 5%.

The dye finish applied to the filaments was deep and washproof.

EXAMPLE 2

Production and dyeing of filaments of an acid-modified polyamide essentially containing structural units corresponding to the formula:

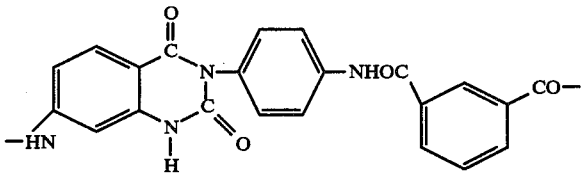

with a yellow dye of constitution (P).

(a) Preparation of the polyamide 670 parts by weight of 3-(p-aminophenyl)-7-amino-2,4-(1H,3H-quinazolinidone and 83.5 parts by weight of sodium di-(4-chloro-3-aminophenyl)-disulphimide were introduced into 3900 parts by weight of absolute dimethyl acetamide, followed by the introduction in portions with continuous stirring at 5° to 10° C of 548 parts by weight of isophthalic acid dichloride. The viscous solution was then stirred at room temperature for about another 12 hours. The hydrochloric acid formed during the polycondensation reaction was arrested with 310 parts by weight of propylene oxide.

(b) Production and dyeing of the filaments

This approx. 23% polyamide solution, which had a viscosity of 1850 poises ($\eta_{rel}$ = 1.7 as measured on a 0.5% solution of the polyamide in N-methyl pyrrolidone at 20° C) was dry-spun through a 72-bore spinneret. The duct temperature was 190° C. The filaments were run off from the spinneret at a rate of 104 meters/min. and wound into package form with a slight residual solvent content.

The two thus formed was then passed at 5 m/min. through an aqueous dye bath which contained approximately 20% by weight of dimethyl acetamide and 10 g/l of dye (P). After a residence time of about 14 seconds in the dye bath, the filaments were washed in boiling water and at the same time initially stretched in a ratio of 1:1.5. Final stretching was carried out after drying on a curved heating surface at 320° C, the stretching ratio being 1:1.3.
tensile strength: 3.0 - 3.4 g/dtex
elongation: 6%.

The dye finish was deep and washproof.

EXAMPLE 3

Production and dyeing of filaments of an acid-modified poly-m-phenylene isophthalamide with a red dye of constitution (N).

(a) Production of the polyamide 2030 parts by weight of isophthalic acid dichloride were added at −20° C to 1048 parts by weight of m-phenylene diamine and 105 parts by weight of sodium di-(aminophenyl)-disulphimide in 820 parts by weight of absolute dimethyl acetamide. The solution which quickly became viscous had another 2 parts by weight of isophthalic acid dichloride added to it after half an hour. The hydrochloric acid formed during the polycondensation reaction was arrested with 200 parts by weight of $CaCO_3$ and 930 parts by weight of propylene oxide.

(b) Production and dyeing of the filaments

The spinning solution thus obtained with a viscosity of 1270 poises at 20° C ($\eta_{rel}$ = 1.85) was dry-spun through a 72-bore spinneret with a bore diameter of 0.2 mm. A temperature of 180° C was maintained in the spinning duct. The take-off rate was 125 m/min.

The resulting dry-spun material was drawn through a dye bath containing 10 g/l of dye (N). The dye bath additionally contained 10% of dimethyl acetamide. The bath temperature was 20° C. After a residence time of approximately 14 seconds in the dye bath, the filaments were introduced into a boiling water bath in which they were washed and at the same time stretched in a ratio of 1:1.5. Final stretching was carried out after drying on a curved heating surface at a temperature of 270° C, the stretching ratio being 1:1.4.
tensile strength: 2.9 - 3.5 g/dtex
elongation: 25%.

The filaments had a deep red, washproof dye finish.

EXAMPLE 4

Production and dyeing of filaments of an acid-modified polyamide essentially containing structural units corresponding to the formula:

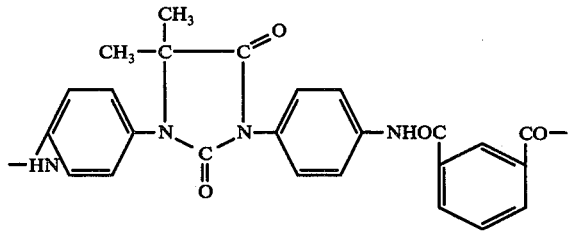

with a yellow dye of constitution (P).

(a) Production of the polyamide 775 parts by weight of 1,3-bis-(p-aminophenyl)-5,5-dimethyl-hydantoin and 111 parts by weight of sodium 4-chloro-3-aminophenyl-3'-aminophenyl disulphimide were dissolved in 435 parts by weight of absolute N-methyl pyrrolidone, followed by the addition in small portions at 5° to 10° C of 558 parts by weight of isophthaloyl chloride. The viscous solution was stirred at room temperature for about another 12 hours. The hydrochloric acid formed during the polycondensation reaction was arrested with an equivalent quantity of propylene oxide.

(b) Production and dyeing of the filaments

This viscous solution ($\eta$ = 2000 poises $\eta_{rel}$ = 1.75 as measured on a 0.5% solution of the polyamide in N-methyl pyrrolidone at 20° C) was spun by the dry spinning process. The filaments were run off at 110 meters per minute from a 120-bore spinneret. The duct temperature was 210° C.

The resulting dry-spun material, had a slight residual solvent content, was passed through a dye bath containing 10 g/l of dye (P) at a bath temperature of 50° C. The residence time in the dye bath amounted to 14 seconds. The dyed filaments were initially stretched in boiling water in a ratio of 1:1.6 dried and then stretched to completion on a curved heating surface at 330° C. in a ratio of 1:1.4.

tensile strength: 2.5 - 3.1 g/dtex elongation: 8%.

The dye finish on the filaments was deep and washproof.

What we claim is:

1. A process for the production of dyed filaments of aromatic polyamides which comprises continuously dyeing dryspun gel filaments of an aromatic polyamide containing acidic groups before or during stretching, in an aqueous dyebath containing a water-soluble, cationic dye in dissolved form.

2. The process of claim 1 wherein the aromatic polyamide further contains heterocyclic groups.

3. The process of claim 1, wherein the filaments are passed before stretching through an aqueous bath containing said cationic dye, and are subsequently stretched.

4. The process of claim 1, wherein the filaments are prestretched during dyeing in said aqueous dye bath.

5. The process of claim 1, wherein said aqueous dye bath contains from 0.01 to 5% by weight of dye in dissolved form.

6. The process of claim 1, wherein said aqueous dye bath has a temperature of from 20° to 100° C.

7. The process of claim 1, wherein said aqueous dye bath additionally contains from 1 to 40% by weight, based on the total weight of the bath, of a polar organic solvent.

8. The process of claim 7, wherein said polar organic solvent is a member selected from the group consisting of dimethyl acetamide, N-methyl pyrrolidone, dimethyl formamide and hexamethyl phosphoric acid tris amide.

9. The process of claim 1, wherein said aromatic polyamide is an acid-modified poly-m-phenylene isophthalamide.

10. The process of claim 1, wherein said aromatic polyamide is an acid-modified heterocyclic polyamide corresponding to the formula:

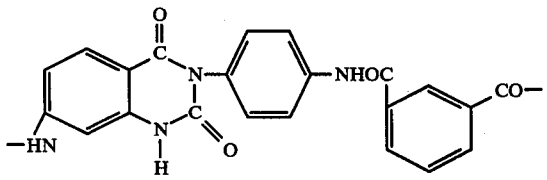

11. The process of claim 1, wherein said polyamides are modified by co-condensation with at least one comonomer containing at least one sulphonate group or disulphimide group.

12. The process of claim 1, wherein said polyamides contain from 50 to 500 mVal of acid groups per kg of solid polyamide.

* * * * *